United States Patent [19]

Katoh et al.

[11] 3,945,085

[45] Mar. 23, 1976

[54] METHOD AND APPARATUS FOR PLUCKING FIBER TUFTS FROM A FIBER BALE

[75] Inventors: Takashi Katoh, Kariya; Susumu Otani, Obu, both of Japan

[73] Assignee: Kabushiki Kaisha Toyoda Jidoshokki Seisakusho, Kariya, Japan

[22] Filed: Sept. 5, 1974

[21] Appl. No.: 503,267

[30] Foreign Application Priority Data

Sept. 8, 1973 Japan ..... 48-101548
Sept. 8, 1973 Japan ..... 48-101549

[52] U.S. Cl. ..... 19/80 R
[51] Int. Cl.[2] ..... D01G 7/06
[58] Field of Search ..... 19/80 R, 81, 145.5; 241/101 A

[56] References Cited

UNITED STATES PATENTS

| | | | |
|---|---|---|---|
| 3,208,106 | 9/1965 | Leineweber, Jr. et al. | 19/80 R |
| 3,360,831 | 1/1968 | Morikawa et al. | 19/80 R |
| 3,795,943 | 3/1974 | Eckrodt | 19/80 R |
| 3,820,197 | 6/1974 | Jeanmaire | 19/80 R |

*Primary Examiner*—Dorsey Newton

[57] ABSTRACT

An improved method and apparatus for plucking fiber tufts from a fiber bale held by a supporting frame which is reciprocally displaced along a carrying passage over a plucking roller. A pair of conveyer means are disposed with an intervened space therebetween and the plucking roller is disposed in the abovementioned intervened space. An auxiliary conveyer means is disposed at a position adjacently outside one of the conveyer means. These three conveyer means are arranged in an alignment. The supporting frame is capable of being reciprocally displaced by the conveyer means between displacing terminals on said conveyer means and is capable of being displaced to a waiting position on one of the conveyer means which is outside of the displacing terminal on that conveyer means and at a side of the auxiliary conveyer means.

A door means of the supporting frame is opened during the displacing motion of the supporting frame to the waiting position, and then a fresh fiber bale reserved on the auxiliary conveyer means is supplied into the supporting frame, thereafter the supporting frame is displaced to the normal operational position thereof. A loading plate is mounted on the supporting frame so as to uniformly press the fiber bale during the bale plucking operation. All of the above-mentioned operations are carried out automatically.

12 Claims, 9 Drawing Figures

METHOD AND APPARATUS FOR PLUCKING FIBER TUFTS FROM A FIBER BALE

SUMMARY OF THE INVENTION

The present invention relates to an improved method and apparatus for plucking fiber tufts from a pressed fiber bale held by a supporting frame which is reciprocally displaced over a plucking roller.

In the conventional spinning process, several different types of bale plucking machines have been utilized for plucking fiber tufts from a pressed fiber bale. For example, in a plucking machine hereinafter identified as $X_1$, a pair of conveyer belts are disposed at the same horizontal level with an intervened space therebetween and a plucking roller is disposed between the above-mentioned conveyer belts so as to pluck fiber tufts from a fiber bale which is reciprocally displaced over the plucking roller by means of reciprocal driving motion of the conveyer belts and an auxiliary conveyer belt is disposed at a position adjacently outside one of the above-mentioned conveyer belts and in alignment therewith so as to reserve a fresh fiber bale. When a fiber bale previously supplied to the conveyor belts is exhausted, the reserved fresh fiber bale is automatically supplied to the conveyor belts so as to continue the plucking operation. In another type plucking equipment, hereinafter identified as $X_2$ a plurality of bale plucking machines are arranged in parallel condition, and each bale plucking machine is provided with a device for supplying a fresh fiber bale, and when a previous fiber bale is exhausted, a fresh fiber bale is manually deposited onto the respective supplying devices.

In still another plucking machine, hereinafter identified as $X_3$ which does not have any auxiliary device for reserving a fresh fiber bale and for supplying a reserved fresh fiber bale, a fiber bale is supported by a supporting frame which is reciprocally displaced over a plucking roller and fiber tufts are plucked from the fiber bale which is urged downward under a positive pressure created by a loading means. When the fiber bale is exhausted, the above-mentioned loading means is manually released from the supporting frame and thereafter a fresh fiber bale is disposed into the supporting frame and, then, the plucking operation is commenced again.

In a still further example, the plucking machine hereinafter identified as $X_4$, is formed in a horizontal disc shape, a frame for supporting a fiber bale is disposed above the plucking device and the fiber bale is pushed downward by a loading means so as to effectively pluck fiber tufts from the fiber bale by the plucking device. When the fiber bale is exhausted, the loading means is released from the supporting frame and, thereafter, a fresh fiber bale is supplied onto the supporting frame. Then, the plucking operation is commenced again.

However, in the above-mentioned well-known types of plucking machines $X_1$ and $X_2$, since the sides of the fiber bale are free from guiding or supporting means, the column of the fiber bale may easily become inclined due to uneven plucking of fiber tufts therefrom, which is mainly due to variation of fiber density. Consequently it is very difficult to continue a uniform plucking operation until a complete fiber bale is exhausted.

In the case of the plucking machine $X_3$, the above-mentioned possible inclination of the column of a fiber bale can be prevented by the supporting frame. However, since the supply operation of a fresh fiber bale into the supporting frame is carried out manually, additional labor costs are involved when compared to an automated supply operation. Further the loading means is a dead weight (a plate) applied to the fiber bale and, consequently, it is very difficult to maintain a uniform rate of plucking fiber tufts from the fiber bale during the entire plucking operation of a fiber bale. In the plucking machine $X_4$, since the plucking device is formed in a shape of a horizontal disc, it is impossible to install an auxiliary feeding device which reserves a fresh fiber bale and, consequently, the labor cost for supplying a fresh fiber bale to the plucking device cannot be eliminated.

In the above-described conventional bale plucking machines, the full automation of a plucking operation which maintains uniform plucking of fiber tufts, together with supplying a fresh fiber bale, cannot be carried out.

The principal object of the present invention is to solve the above-mentioned problems of the conventional bale plucking machines by providing an improved method and apparatus for plucking fiber tufts from a pressed fiber bale supported by a supporting frame which is reciprocally displaced over a plucking roller, wherein a supply movement of a fresh fiber bale into the supporting frame is automatically carried out.

In the bale plucking apparatus according to the present invention, a pair of conveyer means are disposed at an identical horizontal level and in alignment with an intervened space therebetween, and a plucking roller is disposed at a position between the conveyor means in such a condition that it is capable of plucking fiber tufts from a fiber bale supported by a supporting frame which is reciprocally displacing over the plucking roller. An auxiliary conveyer means is disposed at a position adjacent to one of the above-mentioned conveyer means so as to reserve a fresh fiber bale and supply the fresh fiber bale to the above-mentioned conveyer means. When a fiber bale being processed is exhausted, means for detecting such condition issues a signal to displace the supporting frame toward an outside end of the abovementioned conveyer means. The supporting frame is provided with a door at a side facing the auxiliary conveyer means and the door is capable of opening during the displacement of the supporting frame from one of the terminals of the reciprocal displacement of the supporting frame on the above-mentioned conveyer means toward the auxiliary conveyer means. When the supporting frame is displaced to an end portion of the above-mentioned conveyer means, the door of the supporting frame has been completely opened. In this condition, the auxiliary conveyer means is actuated to be driven, so that a fresh fiber bale is supplied into the supporting frame and, thereafter, the auxiliary conveyer means is again driven so as to displace the supporting frame to the plucking roller. According to the above-mentioned displacement of the supporting frame, the door is automatically closed and after the supporting frame passes the above-mentioned terminal of the reciprocal displacement of the supporting frame, the pair of conveyer means work to reciprocally displace the supporting frame over the plucking roller so that the normal plucking operation is continuously carried out.

Further, the above-mentioned supporting frame is provided with means for uniformly loading the fiber bale so as to create a uniform plucking operation.

As mentioned above, a very effective plucking operation of fiber tufts from a fiber bale is continuously carried out so that the above-mentioned drawbacks of the conventional plucking machines can be eliminated.

DETAILED EXPLANATION OF THE INVENTION

Figure 1:
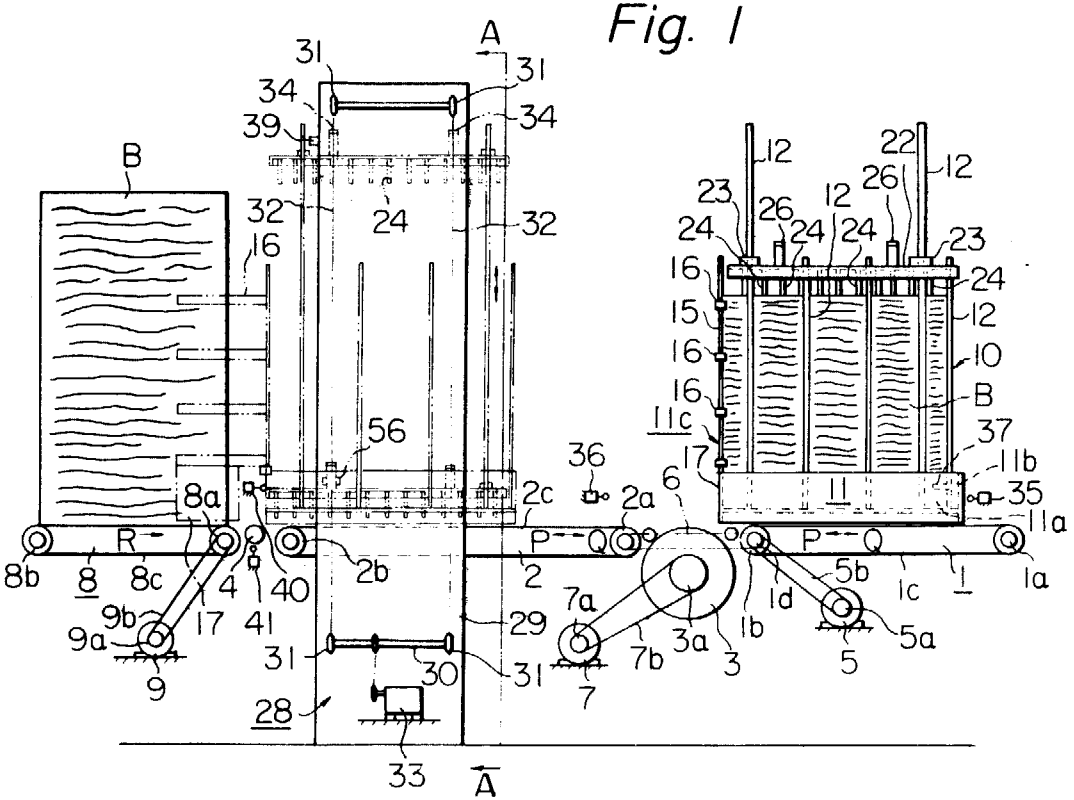
FIG. 1 is a schematic side view of a bale plucking machine according to the present invention.
Figure 2:
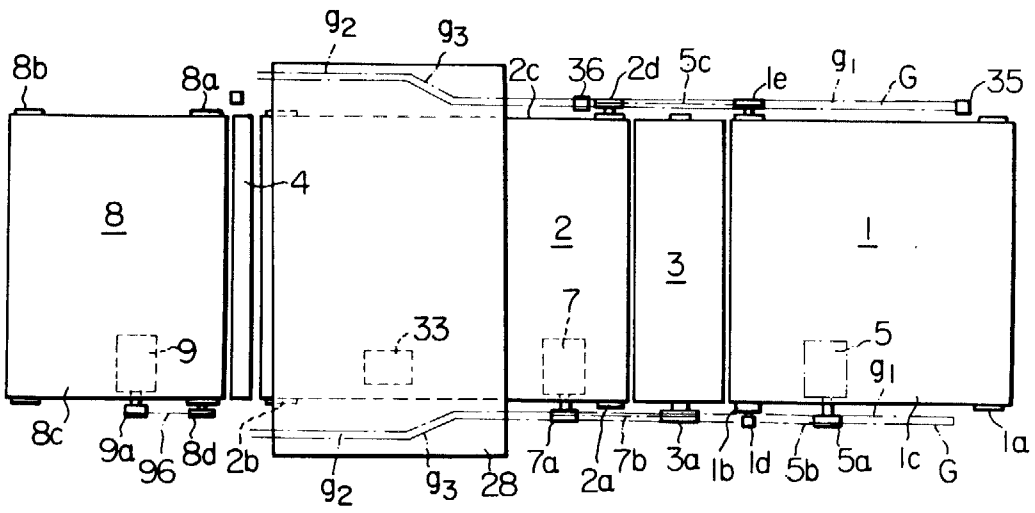
FIG. 2 is a schematic plan view of the bale plucking machine shown in FIG. 1.

Referring to FIGS. 1 and 2, a bale plucking machine according to the present invention comprises a pair of conveyer means 1 and 2, which are aligned with an intervened space therebetween, and a plucking roller 3 disposed at a position in the intervened space in such a condition that the plucking roller 3 is capable of plucking fiber tufts from a fiber bale B reciprocally displacing thereover. The conveyer means 1 comprises a pair of guide rollers 1*a* and 1*b*, and an endless apron 1*c* mounted on the guide rollers 1*a* and 1*b*, while the conveyer means 2 comprises a pair of guide rollers 2*a* and 2*b*, and an endless apron 2*c* mounted on the guide rollers 2*a* and 2*b*. A pulley 1*d* is secured to a shaft of the guide roller 1*b*. A reversible motor 5 is mounted on a machine frame (not shown). A pulley 5*a* is secured to a shaft of the motor 5 and the driving power of the motor 5 is transmitted to the pulley 1d by an endless belt 5*b*. A pulley 1e is secured to another end portion of the shaft of the guide roller 1*b* while a pulley 2*d* is secured to a shaft of the guide roller 2*a* and an endless belt 5*c* is mounted on the pulleys 1*e* and 2*d*. Therefore the driving power of the guide roller 1*b* is transmitted to the guide roller 2*a*. A motor 7 is rigidly mounted on the machine frame and a pulley 7*a* is secured to a shaft of the motor 7, while a pulley 3*a* is secured to the shaft of the plucking roller 3. The driving power of the motor 7 is transmitted to the pulley 3*a* of the plucking roller 3 by way of the pulley 7*a* and an endless belt 7*b* mounted on the pulleys 7*a* and 3*a*. An auxiliary conveyer means 8 is disposed at a position adjacently outside the conveyer means 2 in a condition of alignment to the conveyer means 2. The auxiliary conveyer means 8 comprises a pair of guide rollers 8*a* and 8*b* and an endless apron 8*c* mounted on these guide rollers 8*a* and 8*b*. A motor 9 is rigidly mounted on the machine frame and a pulley 9a is secured to a shaft of the motor 9 while a pulley 8d is secured to a shaft of the guide roller 8*a*. An endless belt 9*b* is mounted on these guide pulleys 9*a* and 8*d* so as to transmit the driving power of the motor 9 to the guide roller 8*a*. A horizontal roller 4 is disposed at a position between the auxiliary conveyer means 8 and the conveyer means 2 at the same level as these conveyer means 2 and 8.

Figure 7:
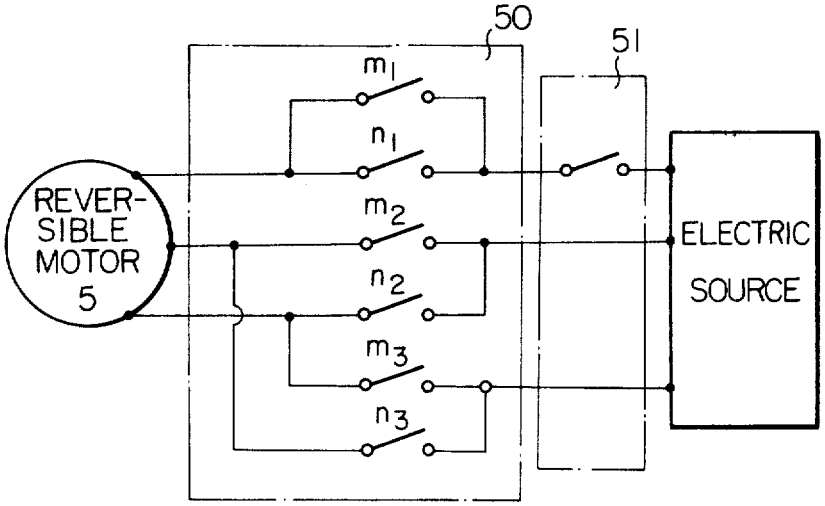
FIG. 7 is a diagram showing a reversible magnetic relay for changing the polarity of input power to a reversible motor utilized for the bale plucking machine shown in FIG. 1.
Figure 8:
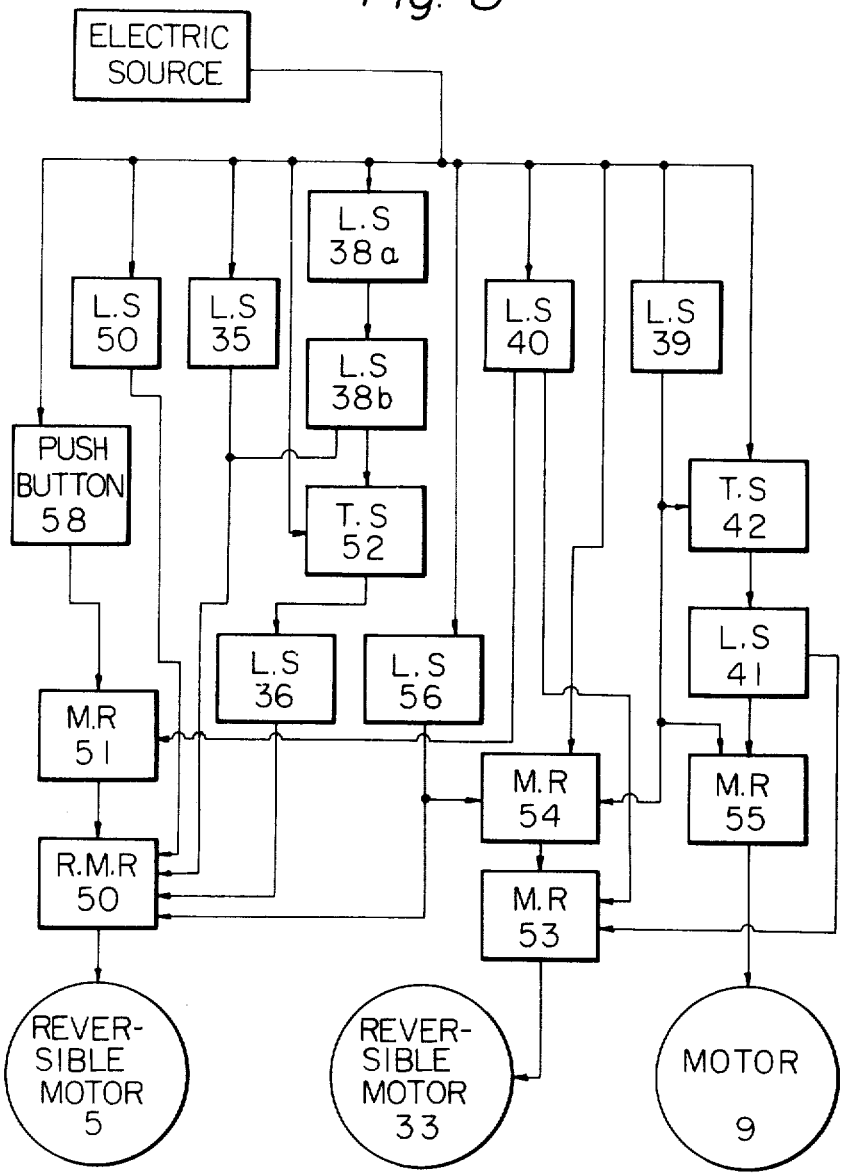
FIG. 8 is a block diagram of a control circuit for operating the bale plucking machine shown in FIG. 1.

A pair of guide grooves G are formed on the machine frame at the both sides of the alignment of the conveyer means 1 and 2 and a supporting frame 10 is disposed on the conveyer means 1 and 2 in such a condition that it is capable of reciprocally displacing along the conveyer means 1 and 2. A first limit switch 35 is secured to the machine frame at a position adjacent to the endless apron 1c in such a condition that the limit switch 35 is capable of being actuated by a projection 37 projected from the supporting frame 10 outwards when the supporting frame 10 is displaced to a terminal of the reciprocal motion thereof on the endless apron 1*c*. A second limit switch 36 is also secured to the machine frame but at a position adjacent to the endless apron 2*c* in such a condition that the above-mentioned projection 37 of the supporting frame 10 is capable of contacting a feeler of the limit switch 36 when the supporting frame 10 is displaced to another terminal of the reciprocal motion thereof on the endless apron 2*c*. When the first limit switch 35 is actuated, the polarity of the input power supplied to the reversible motor 5 is changed so as to drive the endless aprons 1c and 2*c* toward a direction represented by an arrow P (in FIG. 1) and, on the other hand, when the limit switch 36 is actuated, the polarity of the input power supplied to the reversible motor 5 is changed so as to drive the endless aprons 1c and 2*c* toward a direction represented by an arrow Q (in FIG. 1). The above-mentioned changing the polarity of the input power is carried out by means of the reversible magnetic relay 50 shown in FIG. 7, that is, the limit switch 35 closes the contacts $m_1$, $m_2$ and $m_3$, while the limit switch 36 closes the contacts $n_1$, $n_2$ and $n_3$ instead of the contacts $m_1$, $m_2$ and $m_3$.

Figure 3:
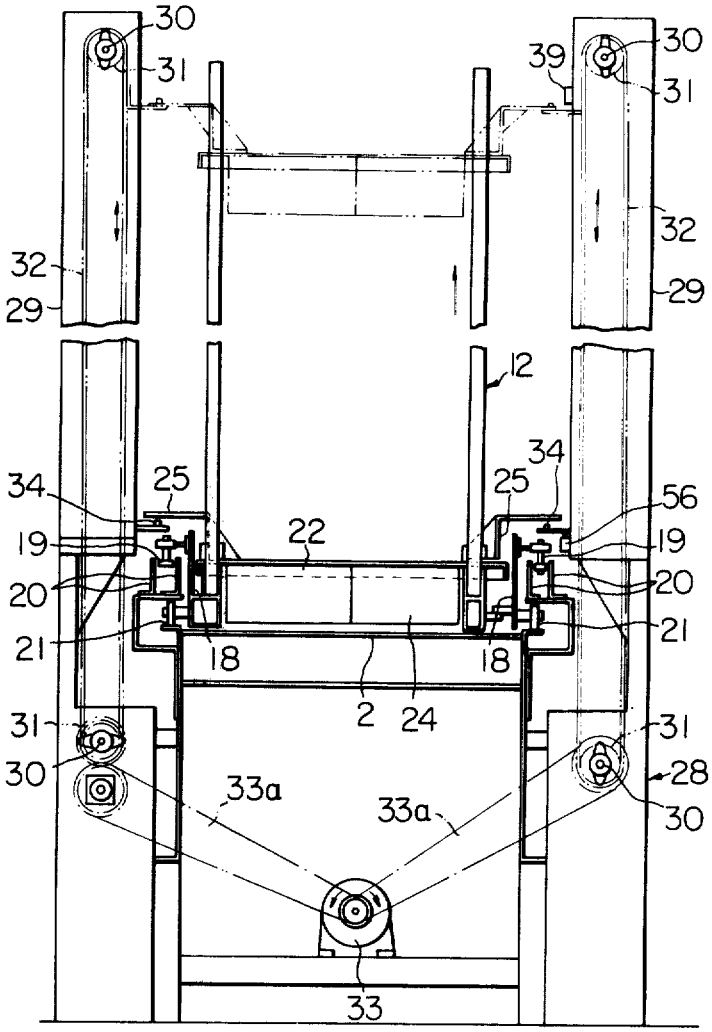
FIG. 3 is a schematic elevation of a supporting frame of the bale plucking machine, looking from a side A—A in FIG. 1.
Figure 4:
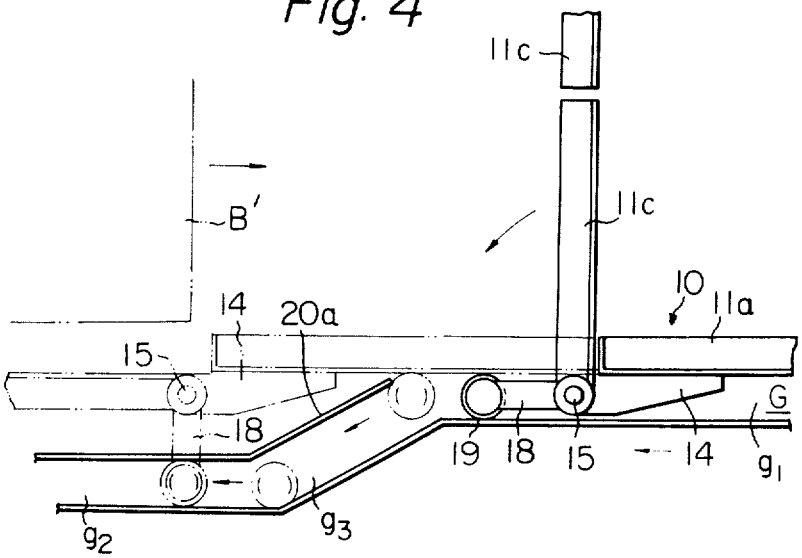
FIG. 4 is a schematic plan view of an end portion of a guide groove in combination with a part of a supporting frame utilized with the bale plucking machine shown in FIG. 1.

Referring to FIGS. 1 through 8, the supporting frame 10 is provided with a frame body 11 wherein the top and bottom ends thereof are open. The frame body 11 comprises a pair of side frames 11*a* arranged in parallel and a transversal frame 11*b* connected to the ends of the side frames 11*a* and a pair of door means 11*c* being capable of opening or closing a side opening of the frame body 11 which faces the transversal frame 11*b*. A plurality of pillars 12 are rigidly mounted on the side frames 11*a* and the transversal frame 11*b* in upright condition. Each door means 11*c* comprises an upright shaft 15 turnably mounted on a horizontal bracket 14 projected from each end portion of each side frame 11*a* at the outside position thereof and a plurality of shutter pieces 16 secured to the upright shaft 15 with a suitable intervened space between two adjacent shutter pieces 16 and a shutter plate 17 secured to the upright shaft 15. A horizontal arm 18 is secured to each upright shaft 15 and a roller 19 is turnably mounted on a free end portion of the horizontal arm 18 (FIG. 4). Each guide groove G (FIGS. 2 and 4) comprises a first guide groove $g_1$ formed in parallel to the longitudinal direction of the conveyor means 1 and 2 and a second guide groove $g_2$ formed in a parallel plane to that of the first guide groove $g_1$ at an end portion of the second conveyor means 2 adjacent to the auxiliary conveyer means 8, and also at a position more outside from the conveyor means 2 in comparison with the disposition of the first guide groove $g_1$, and an outwardly inclined third guide groove $g_3$ which is connected to the first and second guide grooves $g_1$ and $g_2$ as shown in FIGS. 2 and 4. The above-mentioned roller 19 is rotatably inserted into the guide groove G. The dimensional relationship between the length of the horizontal arm 18 and the transversal distance between the center lines of the first and second guide grooves $g_1$ and $g_2$ is designed so as to create a turning motion of the door means 11c about the center axis of the shaft 15 when the roller 19 is displaced from the first guide groove $g_1$ to the second guide groove $g_2$ via the inclined guide groove $g_3$, and vice versa. While the roller 19 is displaced along the first guide groove $g_1$, the door means 11c is maintained in a closed condition and while the roller 19 is displaced along the second guide groove $g_2$, the door means 11c is maintained in an opened condition.

Figure 6:
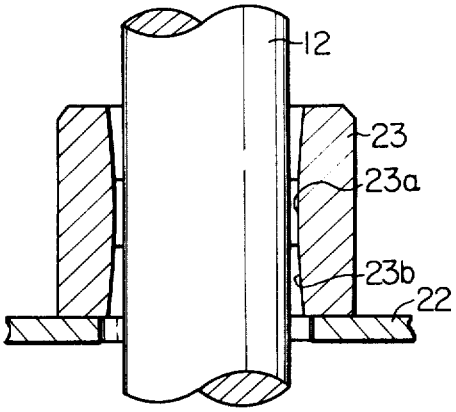
FIG. 6 is a sectional view of a part of the supporting frame shown in FIG. 3.

A loading plate 22 is slidably supported by the pillars 12 secured to each of the end portions of the side frame 11a. The loading plate 22 is provided with four bushes 23 where the corresponding pillars 12 pass therethrough. To create a smooth sliding motion of the loading plate 22 upward or downward by way of the above-mentioned four pillars 12, both end portions 23b of the aperture 23a formed in each bush 23 are radially enlarged as shown in FIG. 6. The loading plate 22 is provided with a plurality of downwardly projected pressing pieces 24 as shown in FIGS. 1 and 3.

Figure 5:
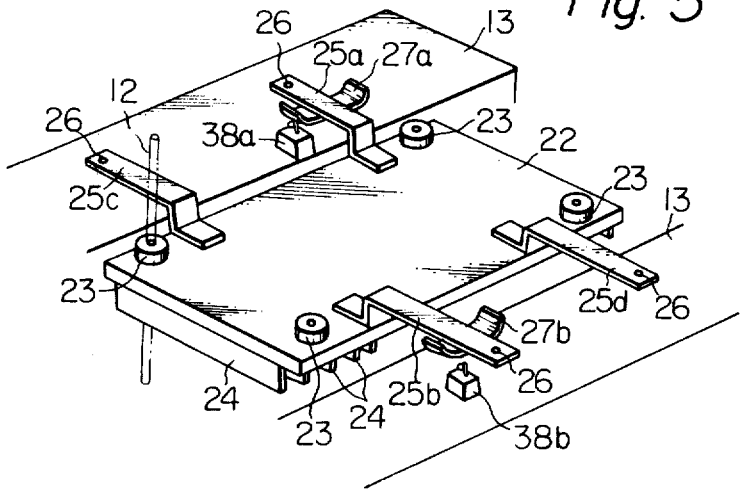
FIG. 5 is a perspective view of a loading means of the supporting frame utilized with the bale plucking machine shown in FIG. 1, which is displaced to its lowermost position.

Referring to FIG. 5, the loading plate 22 is also provided with four receiving pieces 25a, 25b, 25c and 25d which are secured to the respective corner portion of the plate 22 in such a way that they are horizontally projected toward a machine frame 13. Each receiving piece 25a (25b, 25c, 25d) is provided with an aperture 26 (FIG. 5) formed at the free end portion thereof. The aperture 26 of each receiving piece 25a (25b, 25c and 25d) is capable of engaging with a pin 34 (FIG. 3) of a lifting device 28. The relationship between the aperture 26 and the receiving piece 25a (25b, 25c and 25d) will be explained in detail later. A pair of limit switches 38a and 38b are disposed on the machine frame 13 facing the first conveyor means 1 in such a condition that these third limit switches 38a, 38b are arranged in facing condition to the receiving piece 25a, 25b, respectively, which are positioned in diagonal line relationship to each other with respect to the corners of the square shaped loading plate 22. Shoes 27a, 27b, are secured to the bottom surface of the receiving pieces 25a and 25b, respectively, in such a condition that they are capable of facing the above-mentioned third limit switches 38a, 38b, respectively. The lifting device 28 is disposed at a position on the second conveyor means 2 outside the terminal of the reciprocal displacement of the supporting frame 10 as shown in FIGS. 1 and 3. This position is hereinafter referred to as a waiting position. The lifting device 28 is provided with double pairs of supporting frames 29 which are secured to the machine frame in upright condition, horizontal shafts 30 supported by the supporting frames 29 at their top and bottom portions, sprocket wheels 31 secured to the respective horizontal shafts 30 and endless chains 32 mounted on the corresponding sprocket wheels 31. The endless chains 32 are driven by a reversible motor 33 by way of a power transmission mechanism 33a comprising endless belts and speed reduction gears, so that the chains 32 are capable of being reciprocally driven. The reversible motor 33 is connected to the electric source by way of a magnetic relay 53 and a reversible magnetic relay 54 arranged in a series, which will be explained in detail later. The above-mentioned receiving pin 34 is secured to each endless chain 32 so as to engage with or disengage from the aperture 26 of the respective receiving pieces 25a, 25b, 25c, 25d. During the normal bale plucking operation, the pins 34 are positioned at the lowermost position thereof as shown in FIG. 3. The limit switches 38a, 38b are actuated when the loading plate 22 is displaced to the lowermost position thereof and the shoes 27a and 27b contact the limit switches 38a and 38b, respectively. That is, the limit switches 38a, 38b detect the condition that the fiber bale B in the supporting frame 10 is exhausted. When the limit switches 38a, 38b detect the exhaustion of the fiber bale B in the supporting frame 10, the polarity of the input power to the reversible motor 5 is changed so that the endless aprons 1c and 2c are driven toward the direction P and, consequently, the supporting frame 10 is displaced to the auxiliary conveyor means 8. Until the supporting frame 10 arrives at the waiting position on the second conveyer means 2, the limit switch 36 is held in non-working condition. That is, a timer switch 52 (FIG. 8) is interposed in a connection between the electric source and the limit switch 36 and the timer switch 52 is actuated by a signal issued from the limit switches 38a and 38b, so as to not open the connection between the limit switch 36 and the electric source until the supporting frame 10 is displaced to the waiting position.

To prevent unexpected remain of a part of the fiber bale B in the supporting frame 10, the limit switches 38a and 38b are interposed to a connection between the electric source and the reversible motor 5 in a series. A fourth limit switch 39 is disposed on the supporting frame 29 at a position corresponding to the uppermost elevated position of the loading plate 22 so as to detect the elevated condition of the loading plate 22. When the fourth limit switch 39 issues a signal, the reversible motor 33, which drives the lifting device 28, is stopped and the motor 9, which drives the auxiliary conveyor means 8, is driven. That is, the magnetic relay 54 is opened by a signal issued from the limit switch 39, and a magnetic relay 55 which connects the motor 9 with the electric source is closed by the above-mentioned signal issued from the limit switch 39. (FIG. 8) A fifth limit switch 40 is disposed at a position adjacent to the end portion of the second conveyer means 2 as shown in FIG. 1. The fifth limit switch 40 detects the arrival of the supporting frame 10 at the waiting position on the second conveyor means 2. The limit switch 40 issues a signal to open a magnetic relay 51 which connects the electric source and the reversible motor 5 together with the reversible relay 50 in a condition of a series connection. The signal issued from the limit switch 40 actuates a reversible magnetic relay 53 so as to drive the motor 33 in its normal rotational direction so that the loading plate 22 is displaced upward by way of driving the chains 32.

Figure 9:
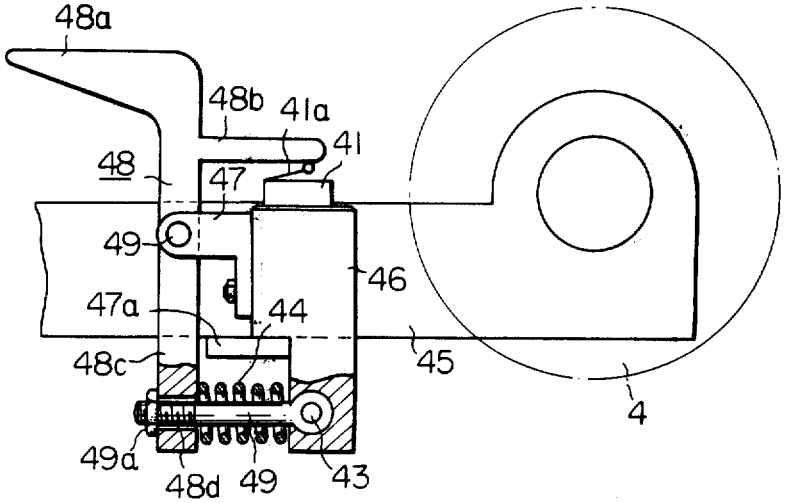
FIG. 9 is a schematic side view of one of the limit switches utilized with the bale plucking machine shown in FIG. 1.

Referring to FIG. 9, a transversal bracket 46 is secured to a pair of side frames 45 of the auxiliary conveyer means 8. At the end of the side frames 45, the roller 4 is rotatably mounted. A sixth limit switch 41 is secured to the transversal bracket 46 at its central portion. A small bracket 47 is secured to the transversal bracket 46 at a position corresponding to the disposition of the limit switch 41. An auxiliary feeler 48 is turnably supported by the small bracket 47 by way of a pin 49. The auxiliary feeler 48 is provided with a horizontally projected portion 48*a* formed at the top end thereof and a small horizontally projected portion 48*b*, which is extended to a position adjacently above the limit switch 41 in such a condition that the portion 48*b* always contacts a feeler 41*a* of the limit switch 41 during the normal plucking operation. The auxiliary feeler 48 is also provided with a lowered extended portion 48c. The portion 48*c* is provided with an aperture 48*d*. A stud 49 is turnably mounted on the bracket 46 by a pin 43, as shown in FIG. 9, and the top end portion of the stud 49 is inserted in the aperture 48*d* and a fastening member 49*a* is secured to the top end of the stud 49. An expansion spring 44 is mounted on the stud 49 at a position between the extended portion 48*c* and the bracket 46 so that the auxiliary feeler 48 is always urged to turn clockwise about the pin 49. The feeler 48 is turned counterclockwise when a fresh fiber bale passes thereon. However, the position of the feeler 48 is limited by the stopper 47*a* secured to the bracket 46. In the above-mentioned condition, the small projected portion 48*b* pushes the feeler 41*a* of the limit switch 41 which opens its electric circuit in this condition and closes its electric circuit when projected portion 48*b* is removed from the feeler 41*a*. The auxiliary feeler 48 is turned counterclockwise when a fresh cotton bale is supplied to the conveyer means 2 and consequently, the front and trailing ends of the fresh cotton bale B, which are possibly projected downward, contact the horizontal projection 48*a*. A time switch 42 (FIG. 8) is interposed between an electric source and the limit switch 41 so as to not issue a signal when the front tail end of a fresh cotton bale contacts the portion 48*a* of the auxiliary feeler 48. That is, the time switch 42 is actuated by the signal issued from the limit switch 39 so as to close the electric circuit at a predetermined time after the motor 9 is driven. The limit switch 41 detects that a fresh cotton bale is supplied into the supporting frame 10 which is positioned at its waiting position on the end portion of the second conveyor means 2. When the limit switch 41 issues a singal, a magnetic relay 55, which connects the electric source to the motor 9, is opened and the reversible magnetic relay 53 is also changed so as to drive the motor 33 in a rotational direction opposite its normal running direction and consequently, the pins 34 of the respective chains 32 are displaced downward. A seventh limit switch 56 is disposed on the supporting frame 29 at a lower position thereof so as to detect the condition that the pins 34 are displaced to their lowermost positions respectively. When the limit switch 56 issues a signal, the reversing magnetic relay 50 changes the electrical connection to the motor 5 from the previous condition of the connection thereof so that the motor 5 is driven in the direction for driving the endless aprons 1*c* and 2*c* toward the direction Q.

The motion of the above-mentioned bale plucking machine is hereinafter explained in detail. Referring to FIGS. 1 through 5, 7 and 8, the operation of the bale plucking machine is commenced by pushing a manually operable push bottom 58 so as to close the magnetic relay 51. In the condition that a fiber bale B is held by the supporting frame 10, when the supporting frame 10 actuates the first limit switch 35, the limit switch issues a signal to close the contacts $m_1$, $m_2$ and $m_3$ of the reversible magnetic relay 50 so that the motor 5 is driven in the direction which drives the endless aprons 1*c* and 2*c* toward the P direction for displacing the fiber bale B held by the supporting frame 10 toward the auxiliary conveyor means 8. Since the motor 7 is continuously driven, the plucking roller 3 plucks fiber tufts from the fiber bale B when the fiber bale B held by the supporting frame 10 passes over the plucking roller 3. The fiber bale B is further displaced toward the end portion of the conveyor means 2. When the second limit switch 36 is actuated by the projection 37 of the supporting frame 10, in other words, the limit switch 36 detects the arrival of the fiber bale B at the displacement terminal thereof on the conveyor means 2, the second limit switch 36 issues a signal to close the contacts $n_1$, $n_2$ and $n_3$ of the reversible magnetic switch 50 instead of the contacts $m_1$, $m_2$ and $m_3$, so that the rotational direction of the reversible motor 5 is changed so as to drive the endless aprons 1*c* and 2*c* toward the Q direction. Consequently, the fiber bale B held by the supporting frame 10 is displaced toward the first conveyer means 1. When the fiber bale B passed over the plucking roller 3, the plucking roller 3 plucks fiber tufts from the fiber bale B. And when the supporting frame 10 again actuates the first limit switch 35, the first limit switch again 35 issues a signal to change the rotational direction of the reversible motor 5 as mentioned above. The above-mentioned reciprocal displacement of the fiber bale B over the plucking roller 3 by the conveyer means 1 and 2 is repeated and, therefore, the fiber tufts are plucked from the bottom portion of the fiber bale B by the plucking roller 3 until the third limit switches 38*a* and 38*b* mounted on the side frames of the first conveyer means 1 detect that the fiber bale B supported by the supporting frame 10 is exhausted. During the above-mentioned plucking operation, the loading plate 22 works to press the fiber bale B by way of the pressing pieces 24 so that the fiber bale B is uniformly urged downward. Consequently, very uniform plucking of the fiber bale can be repeated through the entire plucking operation with respect to a complete fiber bale B. second limit When the fiber bale B is exhausted and, therefore, the loading plate 22 is displaced to its lowermost position by its own weight, the shoes 27*a* and 27*b* of the respective receiving pieces 25*a* and 25*b* actuate the respective third limit switches 38*a* and 38*b* simultaneously. These limit switches 38*a* and 38*b* issue a signal to actuate a time switch 52 which opens a magnetic relay 50 which connects the electric source and the secondlimit switch 36.

The time switch 52 opens the magnetic relay 50 for a predetermined time which is sufficient to maintain the second limit switch 36 in non-working condition when the supporting frame 10 passes over the limit switch 36 toward the waiting position on the second conveyer means 2. Therefore, when the supporting frame 10 actuataes the first limit switch 35, the driving direction of the first and second conveyers 1*c* and 2*c* is changed to the P direction and, consequently, the supporting frame 10 is displaced to the waiting position on the second conveyor means 2. As already explained with reference to FIGS. 1 and 4, when the supporting frame 10 is displacing to the terminal of the waiting position on the second conveyer means 2, the door means 11c is opened and, consequently, the supporting frame 10 is placed in a condition in which it is capable of receiving a fresh fiber bale B.

When the fifth limit switch 40 detects the arrival of the supporting frame 10 at the waiting position on the second conveyor means 2, the magnetic relay 51 is opened by a signal issued from the fifth limit switch 40 so as to stop the reversible motor 5. The reversible motor 33 is also driven by the signal issued from the fifth limit switch 40 so that the receiving pins 34 are displaced upward according to the running of the chains 32. Since, in the above-mentioned upward motion of the pins 34, the receiving pins 34 are engaged with the apertures 26 of the receiving pieces 25*a*, 25*b*, 26*c* and 25*d* secured to the loading plate 22 which has been positioned at its lowermost position, the loading plate 22 is displaced upward until the loading plate 22 actuates the fourth limit switch 39. Accordingly, a space for receiving fresh fiber bale B in the supporting frame 10 is formed. When the fourth limit switch 39 is actuated, the magnetic relay 54, which connects the motor 33 with the electric source, is opened by a signal issued from the fourth limit switch 39 and, consequently, the motor 33 is stopped. The magnetic relay 55 which connects the motor 9 with the electric source is closed by the signal issued from the fourth limit switch 39 so that the auxiliary conveyer means 8 is driven so as to displace a fresh fiber bale B toward a direction represented by an arrow R in FIG. 1. Accordingly, the fresh fiber bale B reserved on the auxiliary conveyer means 8 is displaced into the supporting frame 10 which is positioned at the waiting position on the second conveyer means 2. When the trailing end of the fresh fiber bale B passes over the sixth limit switch 41 as already explained, the magnetic relay 55 is opened by a signal issued from the sixth limit switch 41 so that the driving of the motor 9 is stopped, in other words, the conveyer means 8 is stopped. The reversible magnetic relay 53 changes the connection to the motor 33 from the previous condition of connection thereof by the signal issued from the sixth limit switch 41 so as to drive the motor 33 in a direction for displacing the receiving pins 34 downward. As a result of the above-mentioned downward displacement of the receiving pins 34, the loading plate 22 applies the weight thereof directly to the fresh fiber bale B held in the supporting frame 10 by way of the pressing pieces 24. When the seventh limit switch 56 detects the arrival of the receiving pins 34 at their lowermost positions, the magnetic relay 54 is opened by the signal issued from the seventh limit switch 56 so that the driving of the motor 33 is stopped. The magnetic relay 51 is closed by the signal issued from the seventh limit switch 56 and the reversible magnetic relay 50 closes the connection $m_1$, $m_2$ and $m_3$ by the signal issued from the seventh limit switch 56 and, consequently, the motor 5 is driven so as to drive the endless aprons 1*c* and 2*c* toward the direction Q, respectively. Accordingly, the fresh fiber bale B is displaced to the first conveyer means 1 together with the supporting frame 10. And when the supporting frame 10 is displaced from the waiting position to the first conveyer means 1, the door means 11*c* is closed by the sliding motion of the rollers 19 along the respective guide grooves G.

When the supporting frame 10 is displaced in a reciprocally displacing passage over the plucking roller 3, the normal plucking operation, which is explained already, is continuously carried out. A further fresh fiber bale B is previously supplied on the auxiliary conveyer means 8 during the normal plucking operation.

In the above-mentioned method for plucking fiber tufts from a fiber bale according to the present invention, since the third limit switches 38*a* and 38*b* are disposed to the respective side frames of the first conveyer means 1, when the limit switches 38*a* and 38*b* are actuated due to the mechanical indication of the exhausion of the fiber bale B in the supporting frame 10, if a certain content of the fiber bale B still remains in the supporting frame 10, it is capable of plucking fiber tufts from the above-mentioned remaining content by the plucking roller 3 when the supporting frame 10 is displaced over the plucking roller 3 toward the second conveyer means 2.

Further, if a small unplucked portion of the fiber bale B still remains in the supporting frame 10 after the frame 10 arrives at the waiting position, it is possible to remove such remaining part of the bale B through an intervened space between the roller 4 and the endless apron 2*c* by driving the endless apron 2*c* toward the P direction. This is because the size of above-mentioned intervened space is designed so as to be large enough to permit the dropping of such small unplucked portions of the fiber bale therethrough. Consequently, when a fresh fiber bale B is supplied into the supporting frame 10 which is positioned at the waiting position on the second conveyer means 2, since the supporting frame 10 is completely empty, the supply motion of a fresh fiber bale B into the supporting frame 10 can be carried out smoothly.

In the above-mentioned embodiment, the endless aprons 1*c* and 2*c* are utilized for the first and second conveyer means 1 and 2, respectively. However, instead of utilizing the endless aprons 1*c* and 2*c*, a certain modified mechanism such as a roller conveyer, comprising a plurality of rollers transversely arranged in parallel condition and driven by the motor 5 by way of a power transmission mechanism such as a belt drive mechanism, can be utilized for the first and second conveyer means 1 and 2.

In most cases of practical application of the bale plucking process, a plurality of bale plucking machines are used as a group so as to also carry out the mixing operation. In this case, when the fiber bale in one of the bale plucking machines is exhausted, the bale plucking operation of the other plucking machines should be stopped until a fresh fiber bale is supplied to the supporting frame 10 of the above-mentioned exhausted bale plucking machine. Such stopping operation of the other plucking machine can be simultaneously carried out by opening the magnet relay 51 of each machine by the signal issued from the limit switches 38*a* and 38*b* of the exhausted bale plucking machine. And when the above-mentioned supply motion of a fresh fiber bale B is completed and the motor 5 is driven by the signal issued from the limit switch 43, the motors 5 of the other bale plucking machine are also driven by the signal issued from the limit switch 43. Consequently, the mixing ratio of fibers in the process can be always maintained in a uniform condition.

What is claimed is:

1. In a method for plucking fiber tufts from a fiber bale, by a bale plucking machine comprising a pair of conveyer means and a plucking roller disposed between said conveyer means, during reciprocal displacement of said fiber bale over said plucking roller, an improvement comprising:

holding a fiber bale by a supporting frame being capable of displacement on said conveyer means together with said fiber bale;

detecting exhaustion of said fiber bale in said supporting frame at one of said conveyer means;

thereafter displacing said supporting frame to a waiting position outside the terminal of said reciprocal displacement of the other one of said conveyer means by means of said conveyer means;

positioning said supporting frame at said waiting position by stopping said conveyer means;

then supplying a fresh fiber bale into said supporting frame positioned at said waiting position;

after completion of said supply of said fresh fiber bale into said supporting frame, displacing said supporting frame toward said plucking roller by means of said other one of said conveyer means and, thereafter, carrying out normal bale plucking operation.

2. An improved method for plucking fiber tufts from a fiber bale by a bale plucking machine according to claim 1, further comprising urging said fiber bale downward uniformly by a loading means during reciprocal displacement on said conveyer means.

3. In a bale plucking machine comprising a pair of conveyer means disposed at an identical level with an intervened space therebetween, and a plucking roller disposed in said intervened space, means for driving said conveyer means to and fro so that a fiber bale is reciprocally displaced between two terminals of the reciprocal displacement thereof, an improvement comprising an auxiliary conveyer means disposed at a position adjacently outside an end of one of said conveyer means, a supporting frame for holding said fiber bale disposed on said conveyer means in displaceable condition along said conveyer means, means forming part of said means for driving said conveyer means to and fro, for changing the driving direction of said conveyer means when said supporting frame arrives at said two terminals of said reciprocal displacement of said fiber bale, signalling means for detecting exhaustion of said fiber bale held in said supporting frame, said supporting frame being provided with a door means, means responsive to said means for detecting exhaustion of said fiber bale for actuating said means for driving said conveyor means to displace said supporting frame toward a waiting position outside a region of said reciprocal displacement of said fiber bale on one of said conveyer means without actuating said driving - direction changing means according to a signal issued from said means for detecting exhaustion of a fiber bale, means for opening said door means of said supporting frame while said supporting frame is being displaced to said waiting position, signalling means for detecting arrival of said supporting frame at said waiting position, means responsive to a signal from said means for detecting arrival of said supporting frame at said waiting position, for temporarily driving said auxiliary conveyer means when said supporting frame is positioned at said waiting position for receiving a fresh fiber bale, said means for temporarily driving said auxiliary conveyer means being adapted to transfer a fresh fiber bale reserved on said auxiliary conveyer means into said supporting frame positioned at said waiting position, means for actuating said means for driving said conveyer means to and fro when said supporting frame receives a fresh fiber bale from said auxiliary conveyer means, for displacing said supporting frame toward said plucking roller.

4. An improved bale plucking apparatus according to claim 3, further comprising a loading means for urging said fiber bale held by said supporting frame downwards, said loading means mounted on said supporting frame, means for lifting said loading means to a non working position when said supporting frame is displaced to said waiting position.

5. An improved bale plucking apparatus according to claim 3, wherein said means for driving said conveyer means is a reversible motor and wherein said driving direction changing means comprises in combination with said reversible motor, a reversing magnetic relay connecting said reversible motor to an electric source, a pair of limit switches disposed at respective positions adjacent to said two terminals of reciprocal displacement of said supporting frame, under conditions such that said supporting frame actuates said limit switches, said limit switches issuing signals to actuate said magnetic relay for changing the polarity of input power from the electric source into said reversible motor.

6. An improved bale plucking apparatus according to claim 4, wherein said means for detecting exhausion of said fiber bale held in said supporting frame, comprises in combination with said loading means, a pair of limit switches disposed on side frames of one of said conveyer means which is positioned at an opposite side of said plucking roller with respect to said auxiliary conveyer means, said limit switches being actuated by said loading means when said fiber bale in said supporting frame is exhausted.

7. An improved bale plucking apparatus according to claim 4, wherein said loading means is a loading plate which is capable of upward displacement by action of said lifting means and is capable of free downward displacement.

8. An improved bale plucking apparatus according to claim 3, wherein said opening means is provided with a pair of guide grooves formed adjacently outside said conveyer means, said door means comprising in combination with said opening means, a pair of upright pillars secured to both bottom corners of said supporting frame which face said auxiliary conveyer means, a pair of door members secured to said upright pillars respectively, a horizontal arm secured to a bottom portion of each said upright pillar, roller turnably supported by each said horizontal arm such that each of said rollers is slidably engaged in a corresponding said guide groove, each of said guide grooves being provided with a cam portion which displaces said roller transversely from a respective longitudinal side edge of said conveyer means when said supporting frame is displaced to said waiting position so that said door members are turned about an axial center of said upright pillars respectively.

9. An improved bale plucking apparatus according to claim 3, wherein said means for changing driving direction of said conveyer means includes limit switches and wherein sad means for actuating said means for driving said conveyer means to displace said supporting frame toward said waiting position comprises in combination with said means for changing the driving direction of said conveyer means and said means for detecting exhaustion of said fiber bale, a time switch which adapted to maintain one of said limit switches of said driving direction changing means which is disposed at the reciprocal terminal side of said waiting position in the off condition for a predetermined time until said supporting frame is displaced to said waiting position, said time switch being actuated by a signal issued from said members for detecting exhaustion of said fiber bale.

10. An improved bale plucking apparatus according to claim 3, wherein said means for detecting the arrival of said supporting frame at said waiting position is a limit switch disposed at a position adjacent to the terminal of said waiting position.

11. An improved bale plucking apparatus according to claim 4, wherein said temporarily driving means of said auxiliary conveyer means comprises in combination with said lifting means, a motor for driving said auxiliary conveyer means, a magnetic relay connecting said motor to the electric source, a limit switch associated with said lifting means arranged such that said limit switch is actuated when said loading means is displaced to a non working position, said magnetic relay being closed by a signal issued from said limit switch.

12. An improved bale plucking apparatus according to claim 11, further comprising a horizontal roller disposed at an intervened position between said auxiliary conveyer means and one of said conveyer means, a limit switch for detecting the passing of the trailing end of a fresh fiber bale carried to said supporting frame positioned at said waiting position from said auxiliary conveyer means, said limit switch being adapted to issue a signal to open said magnetic relay of said motor for driving said auxiliary conveyer means.

* * * * *